US006594919B1

(12) United States Patent
Okajima

(10) Patent No.: US 6,594,919 B1
(45) Date of Patent: Jul. 22, 2003

(54) SNOWBOARD BOOTS

(75) Inventor: Shinpei Okajima, Izumi (JP)

(73) Assignee: Shimano, Inc., Osaka (JP)

( * ) Notice: Subject to any disclaimer, the term of this patent is extended or adjusted under 35 U.S.C. 154(b) by 854 days.

(21) Appl. No.: 08/665,679

(22) Filed: Jun. 18, 1996

(51) Int. Cl.[7] ..... A43B 5/00

(52) U.S. Cl. ..... 36/115; 36/117.1; 36/118.2; 36/118.9

(58) Field of Search ..... 36/115, 116, 117.1, 36/118.2, 118.4, 118.7, 118.8, 118.9

(56) References Cited

U.S. PATENT DOCUMENTS

| | | | | | |
|---|---|---|---|---|---|
| 3,530,594 | A | | 9/1970 | Vogel | 36/2.5 |
| 3,597,862 | A | | 8/1971 | Vogel | 36/2.5 |
| 3,807,062 | A | | 4/1974 | Spier | 36/2.5 |
| 4,351,537 | A | * | 9/1982 | Seidel | 36/115 |
| 4,509,276 | A | * | 4/1985 | Bourque | 36/115 |
| 4,979,760 | A | | 12/1990 | Derrah | 280/607 |
| 5,401,041 | A | * | 3/1995 | Jespersen | 280/14.2 |
| 5,435,080 | A | * | 7/1995 | Meiselman | 36/115 |
| 5,437,466 | A | * | 8/1995 | Meibock et al. | 36/115 |
| 5,499,461 | A | * | 3/1996 | Danezin et al. | 36/117.1 |

FOREIGN PATENT DOCUMENTS

| | | | |
|---|---|---|---|
| DE | 3622746 A1 | 1/1988 | A63C/9/00 |
| DE | 4333503 A1 | 4/1995 | |
| EP | 0 646334 A1 | 4/1995 | A43B/5/04 |
| FR | 2719197 | 11/1995 | |
| FR | 94 05408 | 11/1995 | A43B/5/04 |
| JP | 7-171002 | 7/1995 | A43B/5/00 |

OTHER PUBLICATIONS

European search report for EP 96 10 9220, dated Nov. 11, 1996.

* cited by examiner

*Primary Examiner*—M. D. Patterson
(74) *Attorney, Agent, or Firm*—James A. Deland

(57) ABSTRACT

A snowboard boot includes a heel member and a leg member positioned above the heel member. The heel member and the leg member are secured to the boot so that the leg member is capable of movement relative to the heel member about an axis of rotation that is vertically inclined no more than ±45° and that lies within a plane that is inclined relative to a longitudinal plane which divides left and right sections of the boot.

9 Claims, 11 Drawing Sheets

SNOWBOARD BOOTS

BACKGROUND OF THE INVENTION

The present invention is directed to snowboard boots and, more particularly, to snowboard boots which bend to accommodate different riding positions.

Snowboards differ from skis, which are used in pairs, in that only a single board is used. The rider rides on the snowboard facing sideways so that the direction of snowboard travel and the lengthwise direction of the rider are approximately perpendicular. Both rigidity and flexibility are required of snowboard boots. Rigidity is required so that the foot is held firmly by the snowboard boot, and flexibility is required so that the ankle can tilt with respect to the sole.

Some snowboard boots are designed so that the upper and lower regions, particularly the heel section and the cylindrical section or leg section positioned above the heel section, are capable of relative rotation around the approximate centerline of the snowboard boot (the term "approximate" is used because obviously there is not complete lateral symmetry between the left and right boots). Such boots are disclosed in German Patent Publication DE 3,622,746, Japanese Laid-Open Patent Application 7-298092, and elsewhere. In the boots disclosed in these publications, a pivot is used as the swivel design between the heel section and the leg section. The axis of rotation of this pivot lies approximately on the vertical plane which contains the longitudinal line of the snowboard boot. When this type of snowboard boot is used, the ankle can swivel or tilt in unison with the snowboard boot in the lateral direction with respect to the rider.

When the snowboard boots are affixed to the snowboard, the left foot is usually positioned to be the controlling foot. The longitudinal line of the left snowboard boot is usually inclined towards the direction of travel (i.e., towards the left side) with respect to the major axis of the snowboard (the direction of forward progress). This angle of incline is usually about 27°. The main reason for this particular angle of incline is that it facilitates vision in the direction of travel.

In order to make the snowboard go forward in the direction of its major axis, the tilt or swivel of the left foot should be directed in the direction of travel. In known swivel designs, the direction of tilt is inclined with respect to the direction of travel. That is, in known swivel designs, the direction of tilt is inclined by 27° with respect to the direction of travel. These known swivel and tilt designs result in a loss of the propulsive force which propels the snowboard in the direction of travel.

Furthermore, the human ankle is known to have a three-dimensional arch structure that can easily tilt to the left or right when the leg is inclined forward, whereas tilting to the left or right is more difficult when the leg is not inclined. This three-dimensional arch structure thus makes it difficult to bend the foot in the lateral direction when in an erect posture. Swivel and tilt designs must therefore take into account this three-dimensional arch structure, as well as the angle of diagonal attachment of the snowboard boot to the snowboard. Swivel and tilt designs must also be reexamined in connection with piping competition, in which strong propulsive force in the direction of travel is required.

SUMMARY OF THE INVENTION

The present invention is directed to a snowboard boot which allows the rider to apply maximum propulsive force to the snowboard without interfering with the natural movement of the ankle. In one embodiment of the present invention, a snowboard boot includes a heel member and a leg member positioned above the heel member. The heel member and the leg member are secured to the boot so that the leg member is capable of movement relative to the heel member about an axis of rotation that is vertically inclined no more than ±45° and that lies within a plane that is inclined relative to a longitudinal plane which divides left and right sections of the boot.

In other words, a snowboard boot which has general lateral symmetry is designed to pivot around an axis which intersects the plane of symmetry. As noted above, tilting motion of the ankle in the lateral direction is facilitated when it is accompanied by tilting motion in the longitudinal direction. Due to the aforementioned three-dimensional structure of the ankle, pivoting motion in a pivoting plane which is inclined with respect to the vertical plane in which the axis of the anklebone lies is easier than pivoting motion in the vertical plane in which the axis of the anklebone lies. Thus, the tilting design which pertains to the present invention is consistent with the three-dimensional arch structure of the ankle.

When the snowboard boot is attached such that it is inclined diagonally with respect to the major axis of the snowboard, i.e., to the direction of travel, pivoting motion of the foot in the diagonal direction provides propulsive force in the direction of travel to the snowboard boot. Since the rotational force (the component force which acts so as to rotate the snowboard) is zero or very small in this case, the loss in propulsive force produced by the foot acting on the snowboard is minimized, and this propulsive force therefore has high propulsive efficiency. This high propulsive efficiency is useful in piping competitions.

DETAILED DESCRIPTION OF THE EMBODIMENTS

A first embodiment of the snowboard boot according to the present invention will now be described. Ordinary snowboard boots have a rigid sole, a rigid heel section, and a rigid toe section. This rigid sole material is covered by a soft insole member and by other facing materials. In order to reinforce the heel, a rigid member (termed a heel cup, etc.) is attached on the inside or the outside of the facing material. The rigid heel cup is affixed to the sole or facing material in the heel section by stitching or bonding. The rigid heel cup consists of a rigid material such as nylon 66. A leg section extends generally vertically upward from the heel section, and this leg section may include a rigid member to stiffen all or a portion of the leg section.

Figure 1:
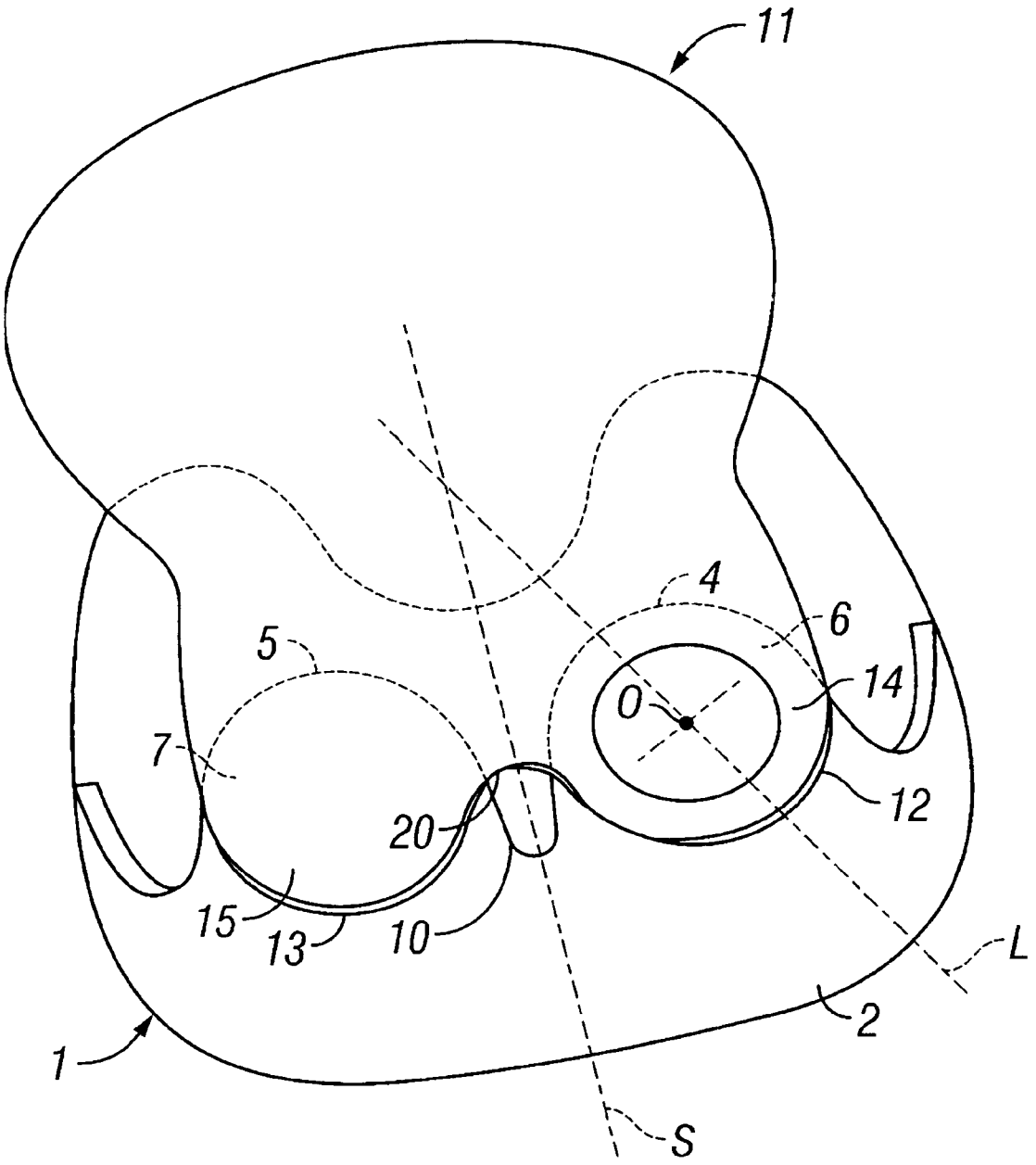
FIG. 1 is an inclined projection of a particular embodiment of an insert for a snowboard boot according to the present invention.

FIG. 1 depicts a particular embodiment of a rigid heel cup 1 and a leg section rigid member 11 which may be used in a snowboard boot according to the present invention. Heel cup 1 comprises a heel cup attached at the inside of the shell of the snowboard boot. The rigid heel cup 1 is a heel cup consisting of a heel section 2. The inside and outside surfaces of the heel section 2 are bowed such that the outside has convex curvature. The rigid heel cup 1 extends out to form a continuous bottom section 3 (FIG. 2) that is bonded to the sole (not shown). The right and left shoes are usually positioned in mirror symmetry to each other, but the left and right shoes are not themselves symmetrical. In this embodiment, the heel section 2 in each shoe is laterally symmetrical. That is, when the shoe is placed on a horizontal plane, the heel section is approximately symmetrical with respect to a vertical longitudinal plane which contains a line in the longitudinal direction. This approximately symmetrical plane is referred to herein as the "plane of approximate symmetry."

In FIG. 1, the right side of the plane of approximate symmetry S is the outside and the left side of the plane of approximate symmetry S is the inside. Thus, the rigid heel cup 1 depicted in the drawing is for the right foot. In this embodiment, the top edge at the back of the heel section 2 has a curved shape that is symmetrical with respect to the plane of approximate symmetry S. This curve comprises an outside upward-protruding convex line segment 4 forming an outside protrusion 6, an inside upward-protruding convex line segment 5 forming an inside protrusion 7, and a central concave line segment 10 that is projected concavely downward at the center.

A leg section rigid member 11, contained in the leg section of the snowboard boot, is located above the rigid heel member 1. The rigid material used for the leg section rigid member 11 is softer than that used for the rigid heel member 1. The leg section rigid member 11 is a member that provides support to the back of the ankle. The lower edge at the bottom of the leg section rigid member 11 has a curved shape that is symmetrical with respect to the plane of approximate symmetry S. This curve comprises an outside downward-protruding convex line segment 12 forming an outside protrusion 14, an inside downward-protruding convex line segment 13 forming an inside protrusion 15, and a central convex line segment 20 that is projected convexly upward at the center. The outside protrusion 6 and the outside protrusion 14 overlap in the longitudinal direction, and the inside protrusion 7 and the inside protrusion 15 overlap in the longitudinal direction. In this embodiment, the outside protrusion 6 and the inside protrusion 7 are assumed to be positioned in front of the outside protrusion 14 and the inside protrusion 15, but this placement is not critical and is a matter of design choice.

The outside protrusion 6 and the outside protrusion 14 are offset to the right with respect to the plane of approximate symmetry S, and the inside protrusion 7 and the inside protrusion 15 are offset to the left. The axis of rotation L is defined as the straight line which passes through the center point O (the position which is the approximate center position of the outside protrusion 6 and the outside protrusion 14) and which intersects the plane of approximate symmetry S. The axis of rotation L has a downward slope in the forward direction, so the axis of rotation L also intersects the plane of the sole. Whether the axis of rotation L has a downward slope or an upward slope in the forward direction is a matter of design. However, a downward slope is favorable in terms of providing a secure fit in the snowboard boot when the foot is inclined forward. The area in which the axis of rotation L intersects the rigid heel cup 1 and the leg section rigid member 11 takes the form of a hinge.

Figure 2:
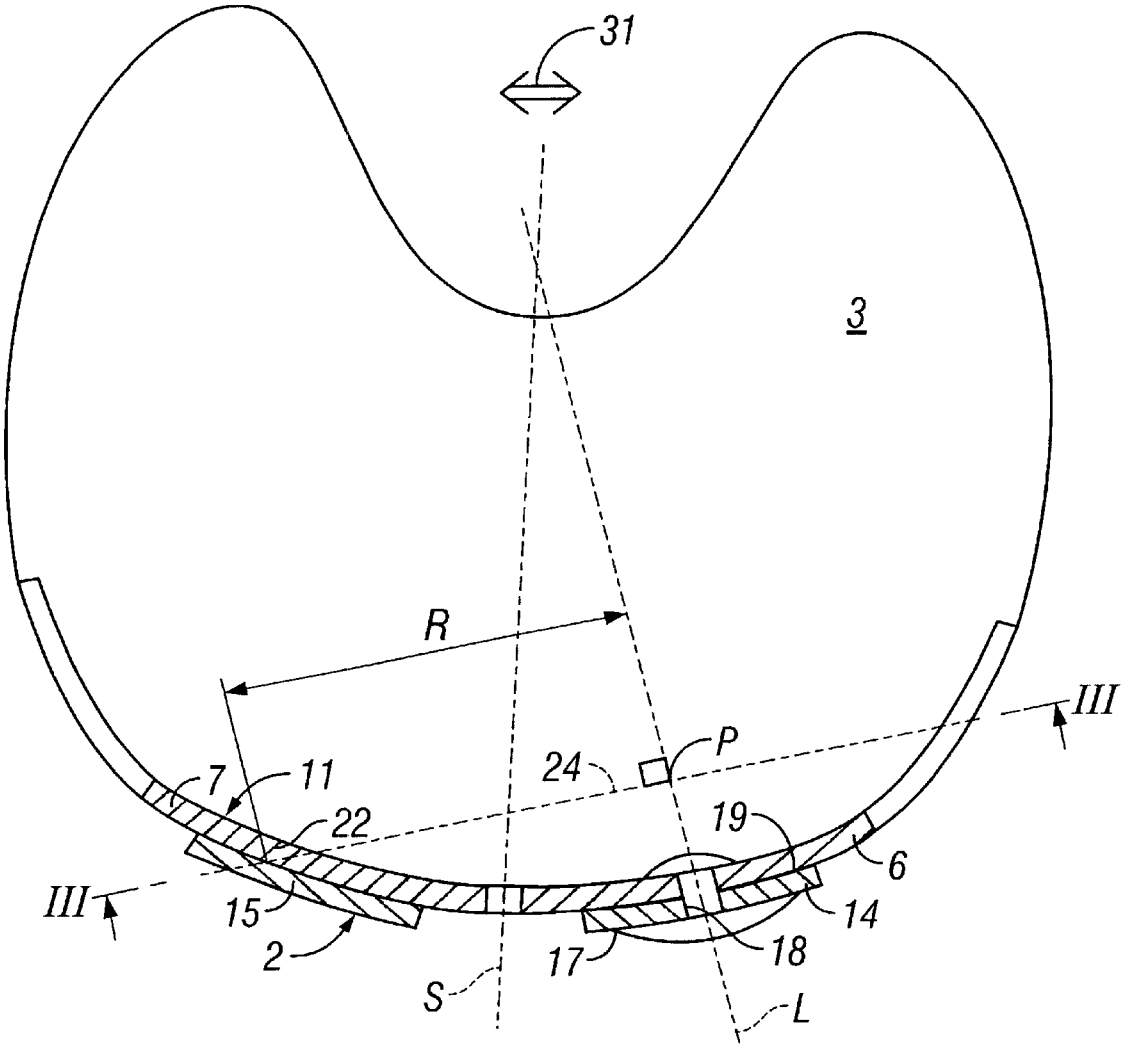
FIG. 2 is a top cross sectional view of the insert shown in FIG. 1.

FIG. 2 depicts the overlapping structure of the outside protrusion 6 and the outside protrusion 14. The outside protrusion 6 is rotatably fixed to the outside protrusion 14 by means of a position-fixing rivet 17. The position-fixing rivet 17 is provided with a pivot or rotating shaft 18, wherein the axis of the rotating shaft 18 is aligned with the axis of rotation L. The face at which the overlapping outside protrusion 6 and the outside protrusion 14 slide together is a spherical face or approximately spherical face 19. The clamping force exerted in the axial direction by the position-fixing rivet 17 is designed to be low in order to minimize frictional force at the spherical face between the outside protrusion 6 and the outside protrusion 14.

FIG. 2 also depicts the overlapping structure of the inside protrusion 7 and the inside protrusion 15. In this embodiment, the position at which the inside protrusion 7 and the inside protrusion 15 overlap is located symmetrically to the position at which the outside protrusion 6 and the outside protrusion 14 overlap with respect to the plane of approximate symmetry S. The overlap face 22 at which the inside protrusion 7 and the inside protrusion overlap has the shape of an arc or a group of arc-shaped curves. In FIG. 2, the radius of the arc is indicated by R.

Figure 3:
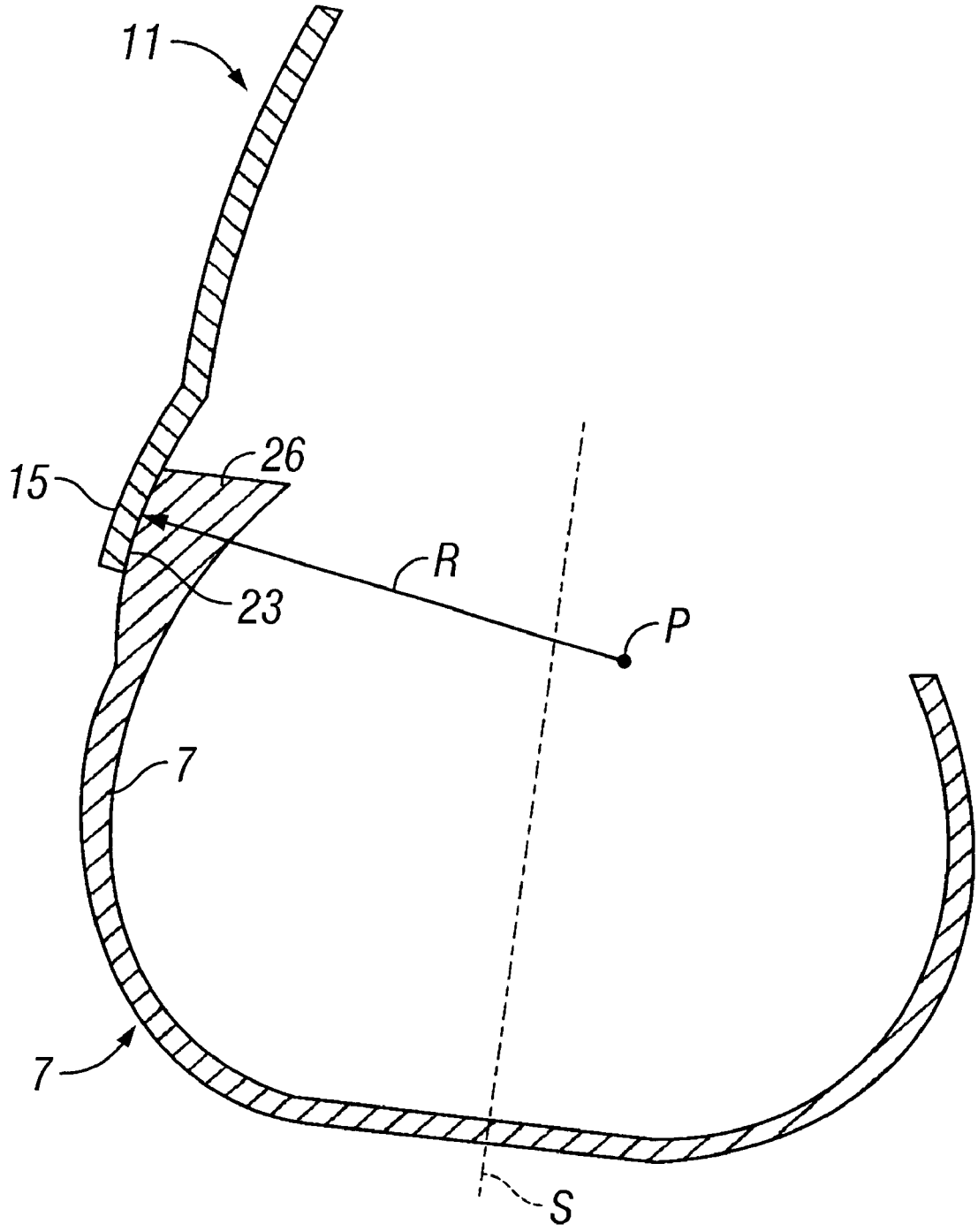
FIG. 3 is a cross sectional view of the insert taken along line III—III of FIG. 2.

FIG. 3 is a cross section cut along the vertical plane which contains the orthogonal line 24 indicated in FIG. 2. The point of intersection of this vertical plane and the axis of rotation L is indicated by P. As shown in FIG. 3, the cross section of the overlap face between inside protrusion 7 and inside protrusion 15 has an arc or an arc-like shape. The line of the arc or arc-like shape will henceforth be termed "approximate arc 23", and it has point P as its center. The inside protrusion 7 is a part of the rigid heel cup 1, and it has a thick section 26. The outside surface of the thick section 26 and the inside surface of the inside protrusion 15 together form approximate arc 23.

In FIG. 2, the direction of snowboard travel is indicated by the arrow 31. The case of propulsive force being exerted on the snowboard towards the right side in FIG. 2 will be described. When the right ankle is bent downward in the direction of the sole or of snowboard travel (towards the upper left of the drawing), the rigid leg section member 11, whose curvature conforms to the back of the ankle, attempts to bend down together with the ankle towards the inside (towards the left leg). When the rigid leg section member 11 is subjected to this pivoting force or thrust, it tilts and rotates in the counterclockwise direction with the free rotation center point (point O) as the center of rotation. The inside protrusion 7 and the inside protrusion 15 are in contact via the arc 23 and slide smoothly.

This tilting occurs on a plane which intersects the plane of approximate symmetry S of the snowboard boot, so resistance is produced by the snowboard boot which has an approximately symmetrical design with respect to the plane of approximate symmetry S. This resistance, which is produced by the structure comprising the rigid heel cup 1 and the leg section rigid member 11 that are in contact through a curved face, restricts the pivoting force against the rigid heel cup 1 and the leg section rigid member 11 so that excessive pivoting is prevented. This resistance, which does not depend upon sliding frictional force between the outside protrusion 6 and the outside protrusion 14 or sliding frictional force between the inside protrusion 7 and the inside protrusion 15, is determined by the three-dimensional arch structure of the snowboard boot, and is thus always held stable at an essentially constant level. The concave section formed between the outside protrusion 6 and the inside protrusion 7 allows the rigid heel cup 1 to deform smoothly, and the concave section formed between the outside protrusion 14 and the inside protrusion 15 allows the leg section rigid member 11 to deform smoothly. The propulsive force of the snowboard will be discussed in greater detail later.

Figure 4:
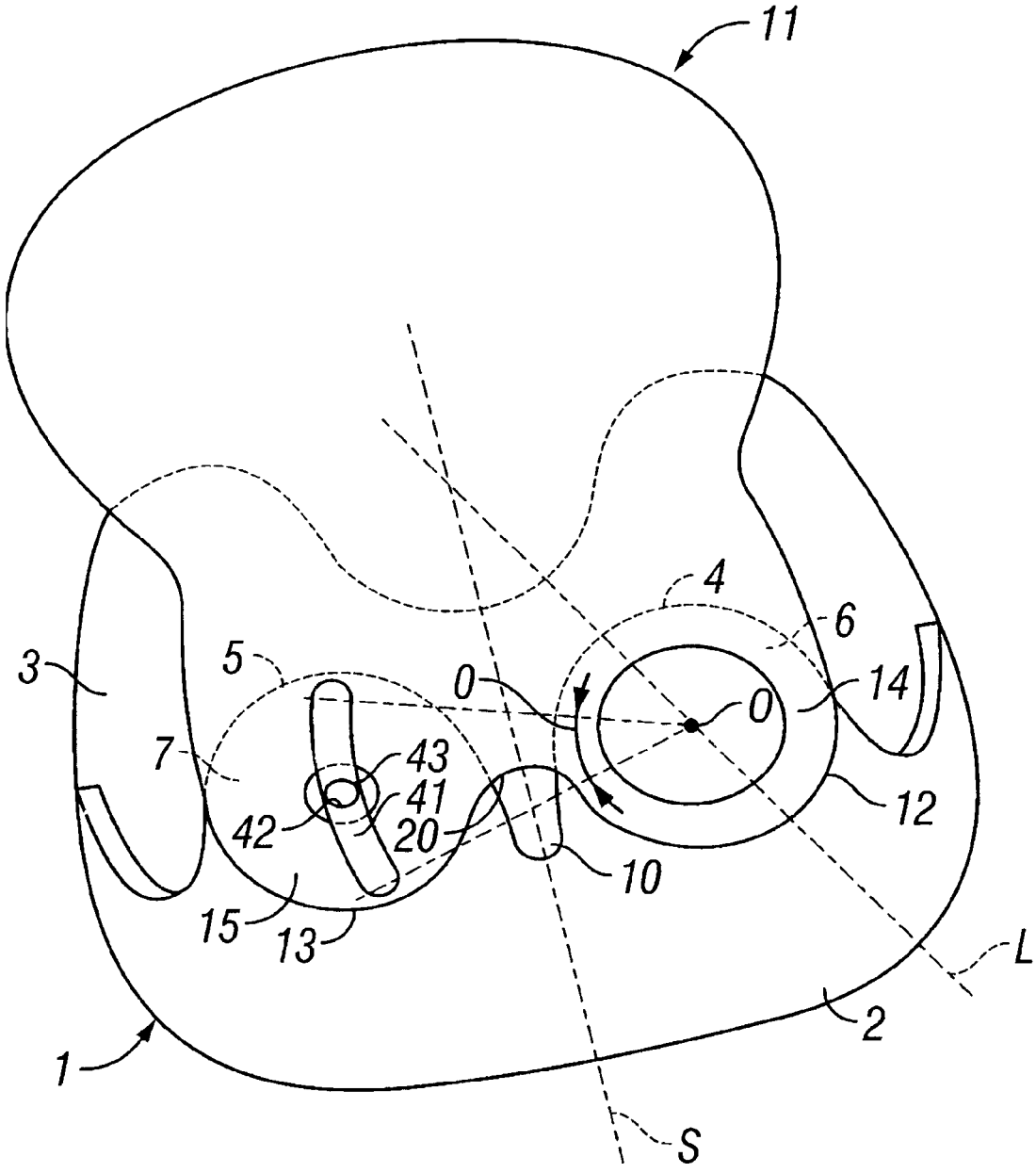
FIG. 4 is an inclined projection of an alternative embodiment of an insert for a snowboard boot according to the present invention.
Figure 5:
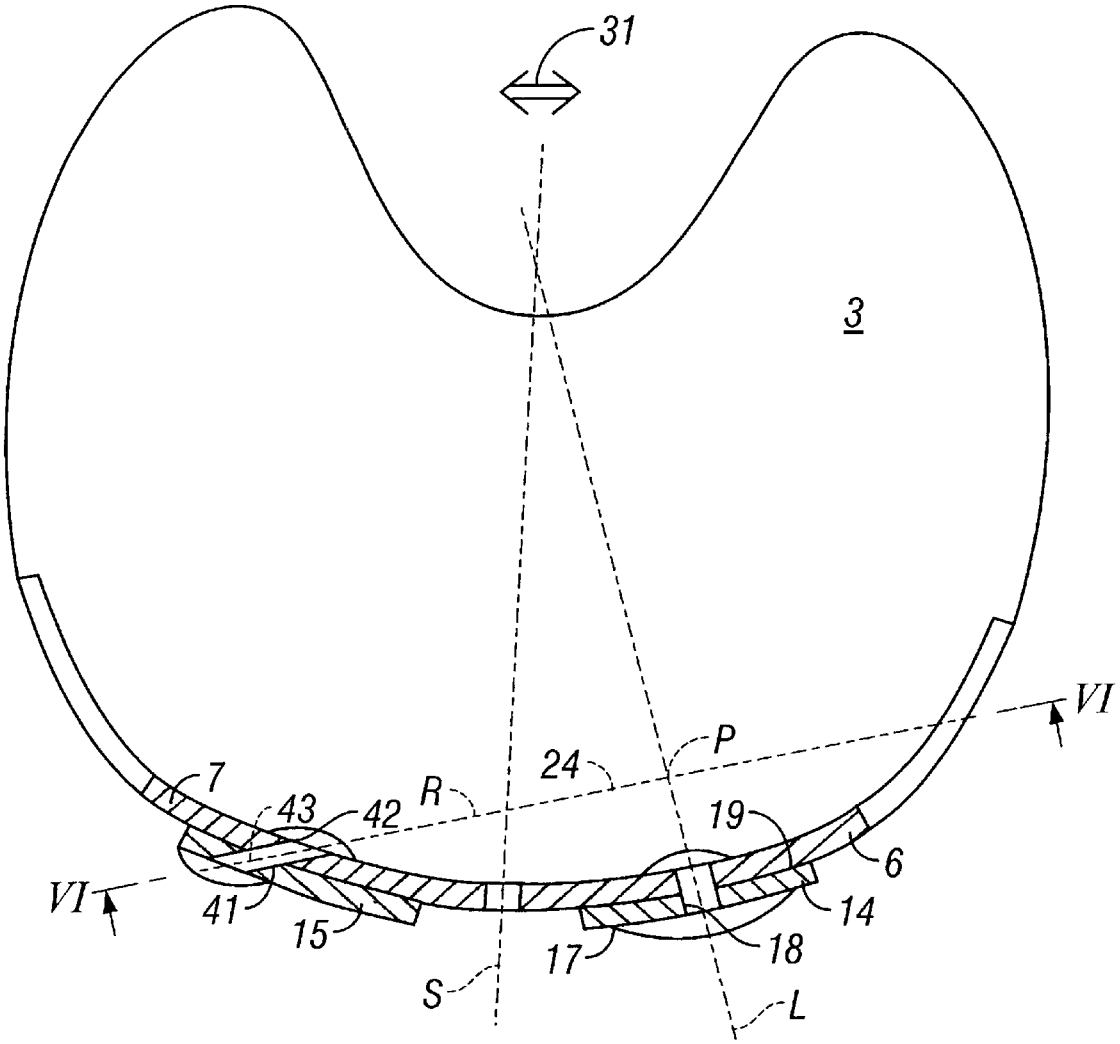
FIG. 5 is a top cross sectional view of the inset shown in FIG. 4.
Figure 6:
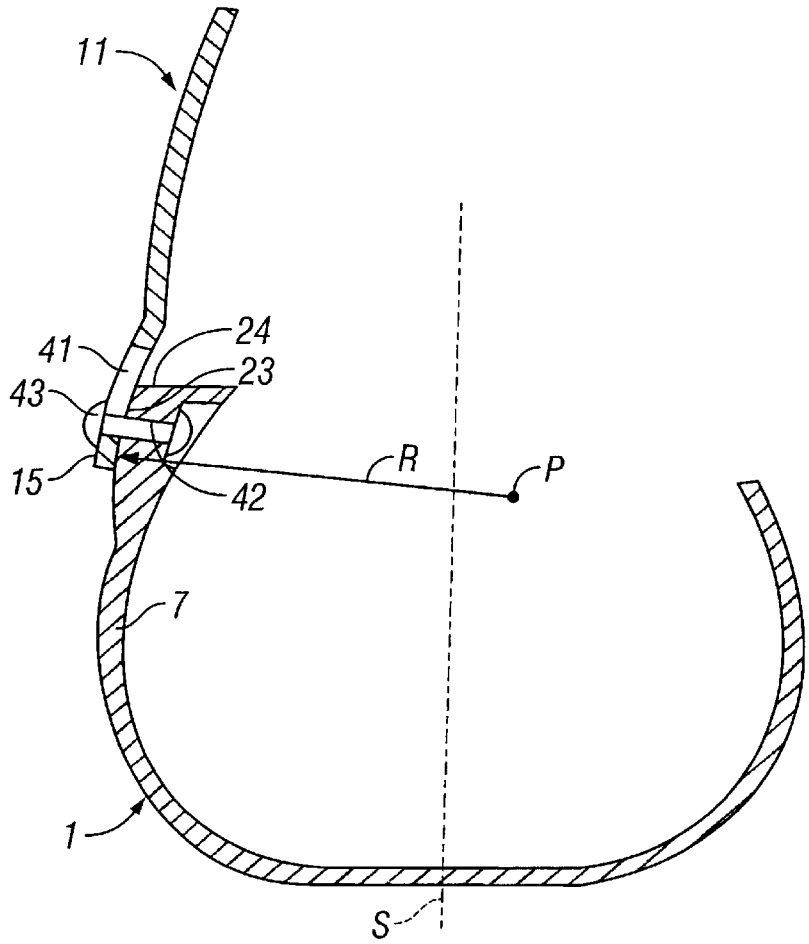
FIG. 6 is a cross sectional view of the insert taken along line VI—VI in FIG. 5.

FIGS. 4, 5, and 6 depict an alternative embodiment of a snowboard boot according to the present invention. FIGS. 4, 5, and 6 are identical to FIGS. 1, 2, and 3, except with regard to the points noted below. In the first embodiment, no means is provided for coupling the inside protrusion 7 and the inside protrusion 15 in the longitudinal direction. This embodiment differs from the first embodiment in that means is provided for coupling the inside protrusion 7 and the inside protrusion 15.

As shown in FIG. 4, the inside protrusion 15 is perforated by a slot 41, and the inside protrusion 7 is perforated by a round hole 42. A rivet 43 is passed through the slot 41 and the round hole 42. Both ends of the rivet 43 are flattened so that the inside protrusion 7 and the inside protrusion 15 are loosely coupled in the longitudinal direction. The slot 41 takes the form of a single arc having the axis of rotation L as its center, and the angle over which the slot 41 extends from its top edge to its bottom edge with reference to the axis of rotation L (at reference point θ) is designated θ. The shaft of the rivet 43 is located in the vertical plane that contains the orthogonal line 24 and on the line that passes through point P. When the leg section rigid member 11 pivots relative to the rigid heel section 1, the rivet 43 moves approximately vertically within the slot 41.

Figure 7:
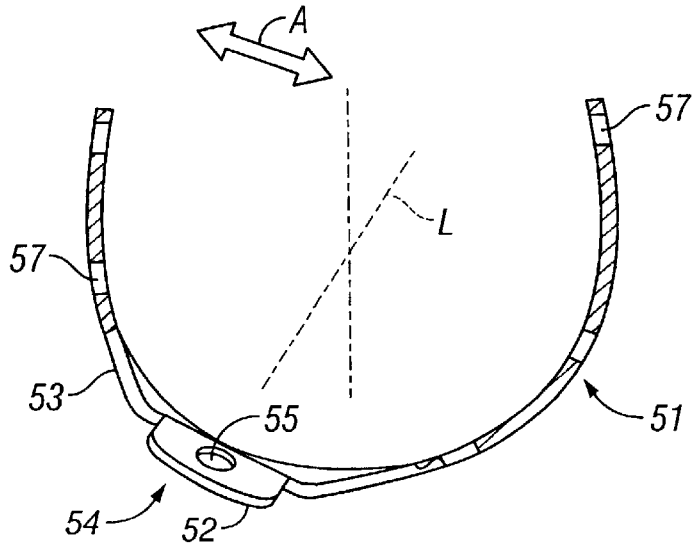
FIG. 7 is a top view of another alternative embodiment of an insert for a snowboard boot according to the present invention.
Figure 8:
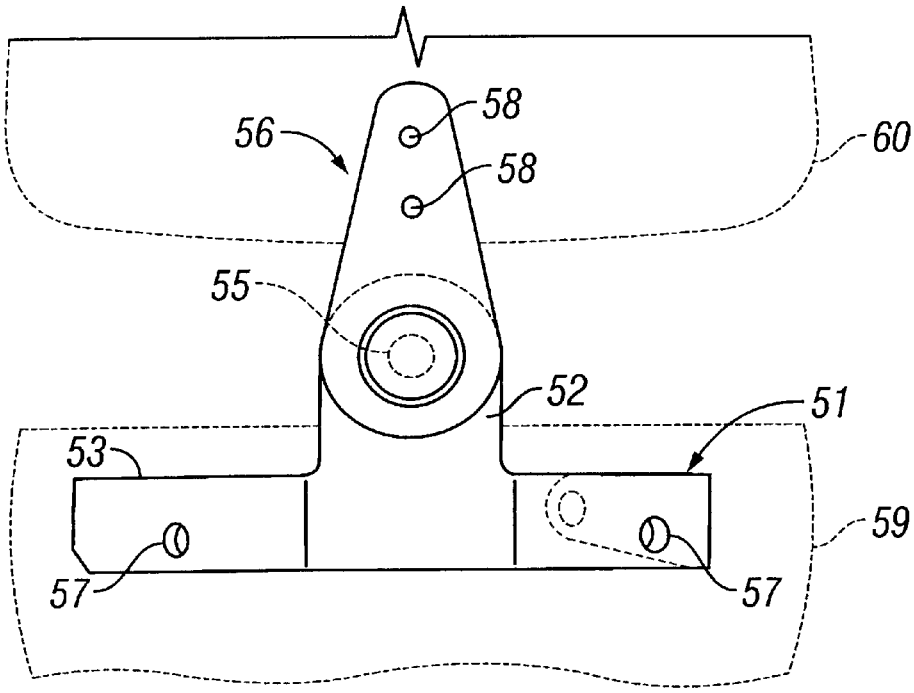
FIG. 8 is a left side cross sectional view of the insert shown in FIG. 7.
Figure 9:
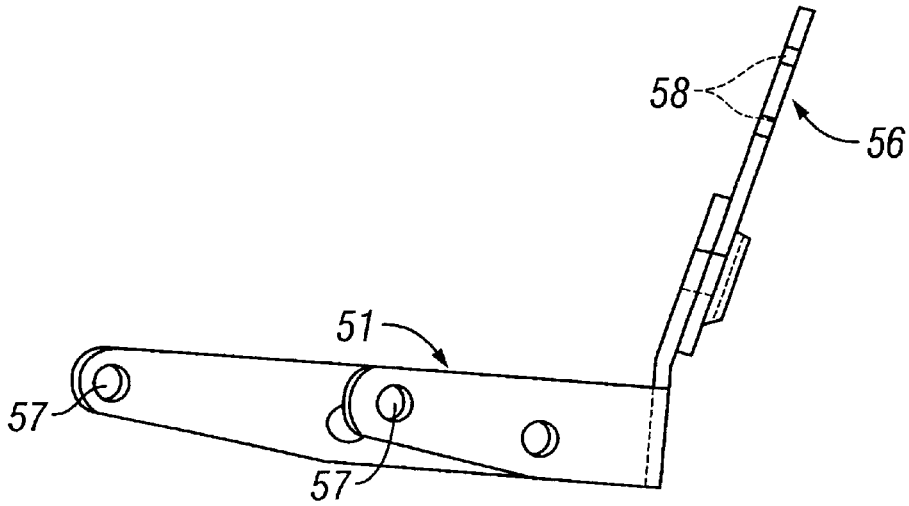
FIG. 9 is a plan view of the insert shown in FIG. 7.

FIGS. 7, 8, and 9 show another alternative embodiment of the present invention wherein metal is substituted for resin as the material for the insert. FIG. 7 shows a metal heel member 51 that constitutes the rigid heel cup. FIG. 8 and FIG. 9 show the metal heel member 51 of the rigid heel cup and a leg section metal member 56 of the leg section rigid member in the assembled state. In this embodiment, the metal member 56 is positioned behind the metal member 51, but the longitudinal relationship of the two elements is a matter of design. Metal members 51 and 56 are for use on the right foot.

Metal member 51 comprises a heel section 52 and a curved member 53 of band form. The heel section 52 rises at a backward incline from the central section of the curved member 53. A spherical surface 54 (FIG. 7) is formed on the outside (the rear surface) of the heel section 52, and a pivot hole 55 perforates the heel section 52. The metal member 56 is positioned above the heel section 52, and it is coupled rotatably to the heel section 52 by a rotating shaft (not shown). The section of the metal member 56 that contacts the heel section 52 has a spherical surface that matches the spherical surface 54.

In FIG. 7, the direction of snowboard travel is indicated by arrow A. The axis of rotation L of the metal member 56 is approximately orthogonal to the direction of travel and slopes slightly downward. That is, the axis of rotation L intersects the plane which contains the plane of the sole. The metal member 51 is perforated in several places by bolt holes 57 so that the metal member 51 may be fixed securely to an elastic shell 59 of a heel section of the snowboard boot by bolts (not shown) which pass through the bolt holes 57. The metal member 56 is also provided with a plurality of bolt holes 58 which are lined up in the vertical direction. The metal member 56 may fixed securely to an elastic shell 60 of a leg section of the snowboard boot by bolts (not shown) which pass through the bolt holes 58.

When the boots are fixed to the snowboard, the plane of approximate symmetry of each snowboard boot can be defined as follows. When the insides of both feet are placed together so as to touch lightly at two points while standing erect, the plane of approximate symmetry is the vertical plane that is parallel to the plane containing these two points, and that contains the back end point of the heel section, which has an approximately spherical surface shape. A right side plane of approximate symmetry SL and a left side plane of approximate symmetry SR defined according to these terms for the left and right foot are depicted in FIG. 10.

Figure 10:
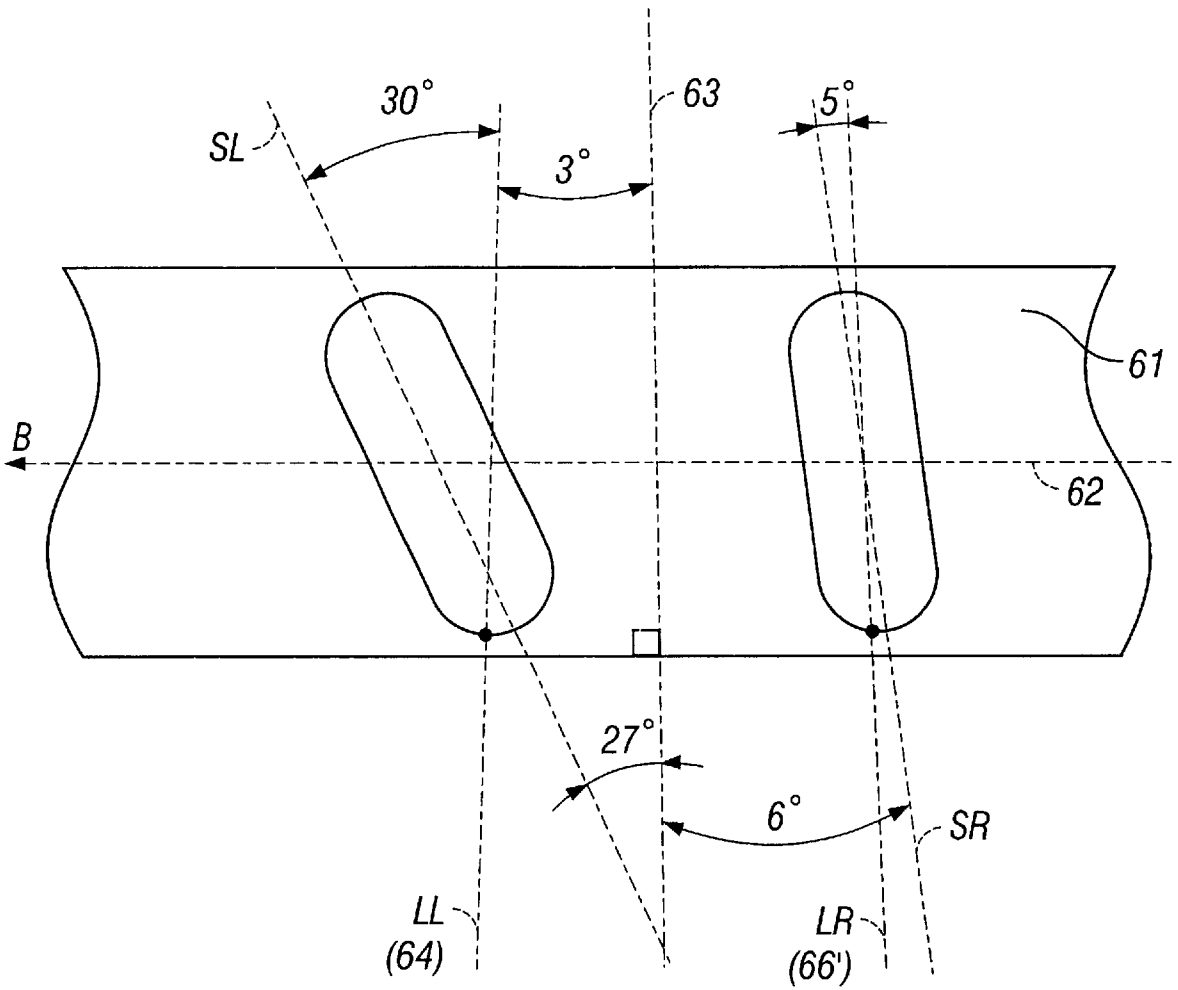
FIG. 10 is a top view depicting the positional relationship of a pair of snowboard boots attached to a snowboard.

In FIG. 10, the direction that is usually designated as the direction of travel is indicated by arrow B. That is, the snowboard is propelled towards the left foot, which is generally the controlling foot. The major axis of the snowboard 61 is indicted by the number 62. The major axis 62 is parallel to the direction of travel B during straight forward advance. The left foot is the controlling foot, and, compared to the left foot, the right foot contributes almost nothing to propulsive force.

The snowboard is propelled in a way that at first appears to contradict the third law of motion. Where the right foot and the left foot exert equal force on the snowboard, the snowboard is not propelled forward since the snowboard and the rider are in an internal force relationship. To state the case in exaggerated terms, the pivoting/tilting structure for the right foot is not very important when the snowboard is propelled unidirectionally to the left.

In this embodiment, the plane of approximate symmetry SL is inclined counterclockwise by 27° with respect to the orthogonal line 63 that is orthogonal to the longitudinal direction, i.e., the major axis 62 of the snowboard. The plane of approximate symmetry SL is inclined in such a way that the front of the foot is pointed more in the direction of travel than is the back of the foot This 27° angle is an optimum value arrived at on the basis of a rule of thumb. Of course, the optimum angle will differ depending on the degree of skill, the type of competition, and the individual characteristics of each rider. The pivoted section, which is the origin of the pivot position of the axis of rotation LL on the left side (the hinge member which is the intersection at which the axis of rotation LL intersects the heel section and the leg section), is offset clockwise from the plane of approximate symmetry SL. The angle between the axis of rotation LL and the plane of approximate symmetry SL is set at 30°. Thus, the axis of rotation LL is contained in an inclined plane which inclines inward at the front.

Usually, the angle formed between the plane of approximate symmetry SL and the inclined plane 64 (the vertical plane which contains the axis of rotation LL) is within the range of 23° to 33° for the foot that is located forward in the direction of travel. The angle formed between the plane of approximate symmetry and the orthogonal line 63 is within the range of 20° to 30° for the left foot. In this embodiment, the angle formed between the plane of approximate symmetry SL and the corresponding inclined plane LL is not smaller than the angle formed by the plane of approximate symmetry SL and the orthogonal line 63. For example, 30° versus 27°, as noted above. Under these conditions, the axis of rotation LL is approximately parallel to the orthogonal line 63. In the illustrated embodiments, the angle formed between the axis of rotation LL and the orthogonal line 63 is set to 3°, so these two are approximately parallel.

In this embodiment, the plane of approximate symmetry SR is inclined by 6° counterclockwise from the orthogonal line 63 which is orthogonal to the longitudinal direction, i.e., the major axis 62 of the snowboard. Thus, the plane of approximate symmetry SR is inclined in such a way that the front of the foot is pointed more in the direction of travel than is the back of the foot. This 6° angle is an optimum value arrived at on the basis of a rule of thumb. Therefore, the optimum angle will differ depending on the degree of skill, the type of competition, and the individual characteristics of each rider.

The pivoted section, which is the origin of the pivot position of the axis of rotation LR on the right side, is inclined clockwise from the plane of approximate symmetry SRF The angle between the axis of rotation LR and the plane of approximate symmetry SR is set at 5°. Usually, the angle formed between the plane of approximate symmetry SR and the inclined plane 65 (the vertical plane which contains the axis of rotation LR) is within the range of 0° to 8° for the foot that is located to the rear in the direction of travel. The angle formed by the plane of approximate symmetry SR and the orthogonal line 63 is within the range of 0° to 10° for the right foot.

In this embodiment, the angle formed between the plane of approximate symmetry SR and the inclined plane 65 is not greater than the angle formed by the plane of approximate symmetry SR and the orthogonal line 63. For example, 5° versus 6°, as noted above. Under these conditions, the axis of rotation LR is approximately parallel to the orthogonal line 63. In the illustrated embodiments, the angle formed by the axis of rotation LR and the orthogonal line 63 is set to 1°, so these two are approximately parallel. The axis of rotation LL and the axis of rotation LR intersect, in which case, the angle formed by the two axes is 4°.

Figure 11:
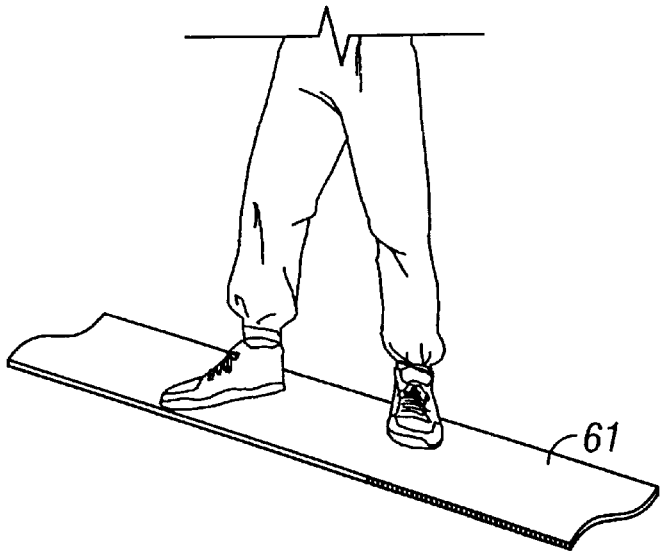
FIG. 11 is an inclined projection depicting bending motion of the foot for both feet.
Figure 12:
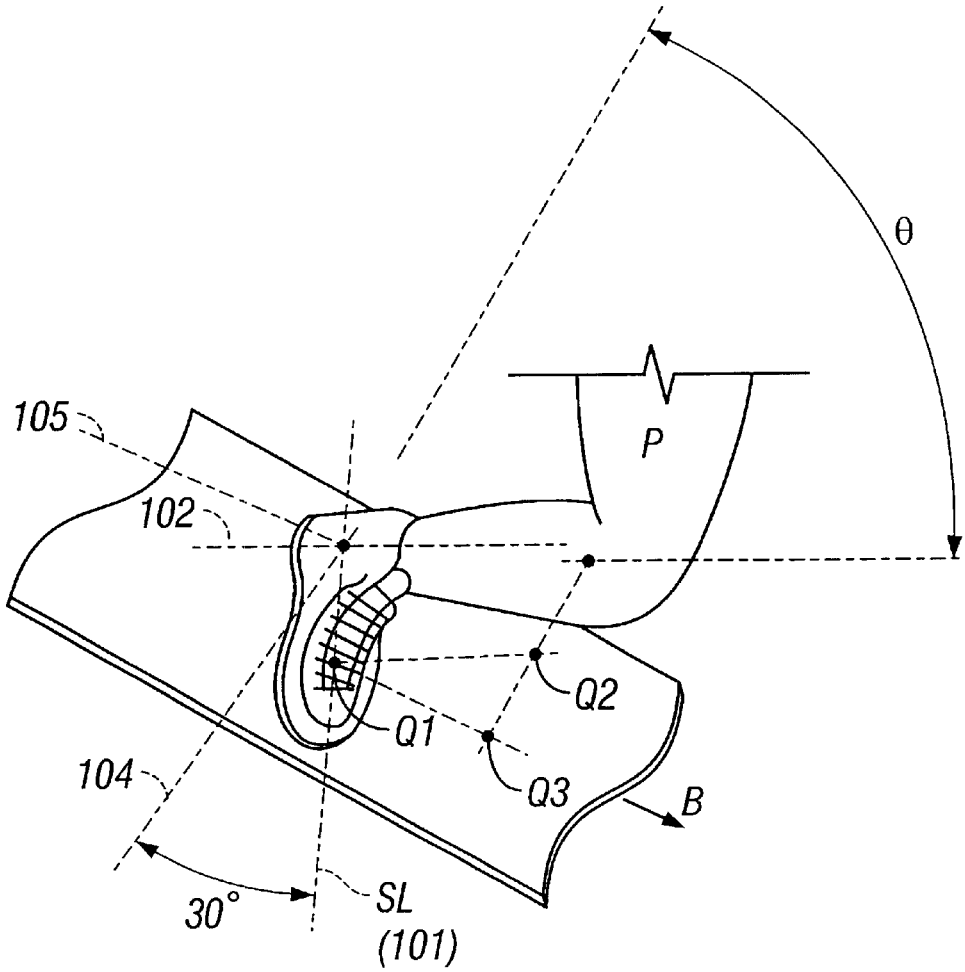
FIG. 12 is an inclined projection depicting bending motion of the foot for the left foot.

By shifting the body weight forward and moving the center of gravity of the body forward, the left foot (which is the controlling foot) becomes the principal point of action, and the snowboard is propelled forward, as depicted in FIG. 11. In this case, the left foot is inclined more towards the front than is the right foot, as depicted in FIG. 12. It is difficult to incline the foot to the left without inclining it forward.

Because of its three-dimensional arch structure, the foot does not readily rotate with the plane of approximate symmetry SL as the axis of rotation. Rather, the foot usually twists while inclining forward and rotates in a plane that is inclined with respect to the plane orthogonal to the plane of approximate symmetry SL. The angle of inclination is about 30° at the greatest the step-in location. To accommodate this fact, in a snowboard boot according to the present invention the rotation mechanism of the leg section rigid member 11 is designed to faithfully reflect this rotation mechanism of the foot. In other words, for the left foot the leg section rigid member 11 is positioned to rotate around the axis of rotation LL in the inclined plane 64 that is inclined about 30° with respect to the plane of approximate symmetry SL. Thus, the foot can pivot together with the snowboard boot without undue strain. Furthermore, the direction in which the foot pivots is approximately in the vertical plane which contains the major axis 62 of the snowboard. The shift in the center of gravity produced by pivoting of the foot effectively generates propulsive force in the direction of travel of the snowboard (direction B). With conventional pivot mechanisms, the force F applied to the snowboard by the foot produces a lesser thrust of $\cos(30)\cdot F$ and requires a bending motion which is at odds with the structure of the foot.

FIG. 12 illustrates the difference between motion of a conventional snowboard boot and a snowboard boot according to the present invention. As illustrated in FIG. 12, as an arbitrary point P located on a forward-leaning leg rotates around an axis 101 which extends in the longitudinal direction of the foot (as in a conventional pivoting snowboard boot), the location of the point defined by dropping down from point P at a right angle to the horizontal plane shifts from Q1 to Q2. The straight line which connects Q1 and Q2 is parallel to the line 102 which is orthogonal to the axis 101. From the standpoint of the three-dimensional arch structure of the foot, such rotation is difficult.

When the foot rotates by an angle $\gamma$ (not shown) on an axis defined by an inclined line 104 inclined inward from the axis 101 by a certain angle (30° in the embodiment described), point P shifts from Q1 to Q3. The straight line which connects Q1 and Q3 is parallel to the line 105 which is orthogonal to the inclined line 104 which is the axis in this case. From the standpoint of the three-dimensional arch structure of the foot, such rotation is easy. The fact that, under circumstances of a reasonable degree of rotation, the relationship between the angle of lateral rotation $\gamma$ and the longitudinal angle $\theta$ is such that $\gamma=F(\theta)$ can be readily ascertained by bending the leg. This type of motion is used in snowboarding.

In piping competition, the direction of travel is both to the right and to the left. In this case, the plane of approximate symmetry is designed to be approximately orthogonal to the direction of the major axis of the snowboard. The inclined planes 64 and 65 are inclined at angle of less than 30° with respect to the plane of approximate symmetry. This has the advantage that even if a loss that reduces the component force in the direction of travel should be produced, the extent of the loss is less than that which would occur had bending of the foot not been facilitated.

Figure 13:
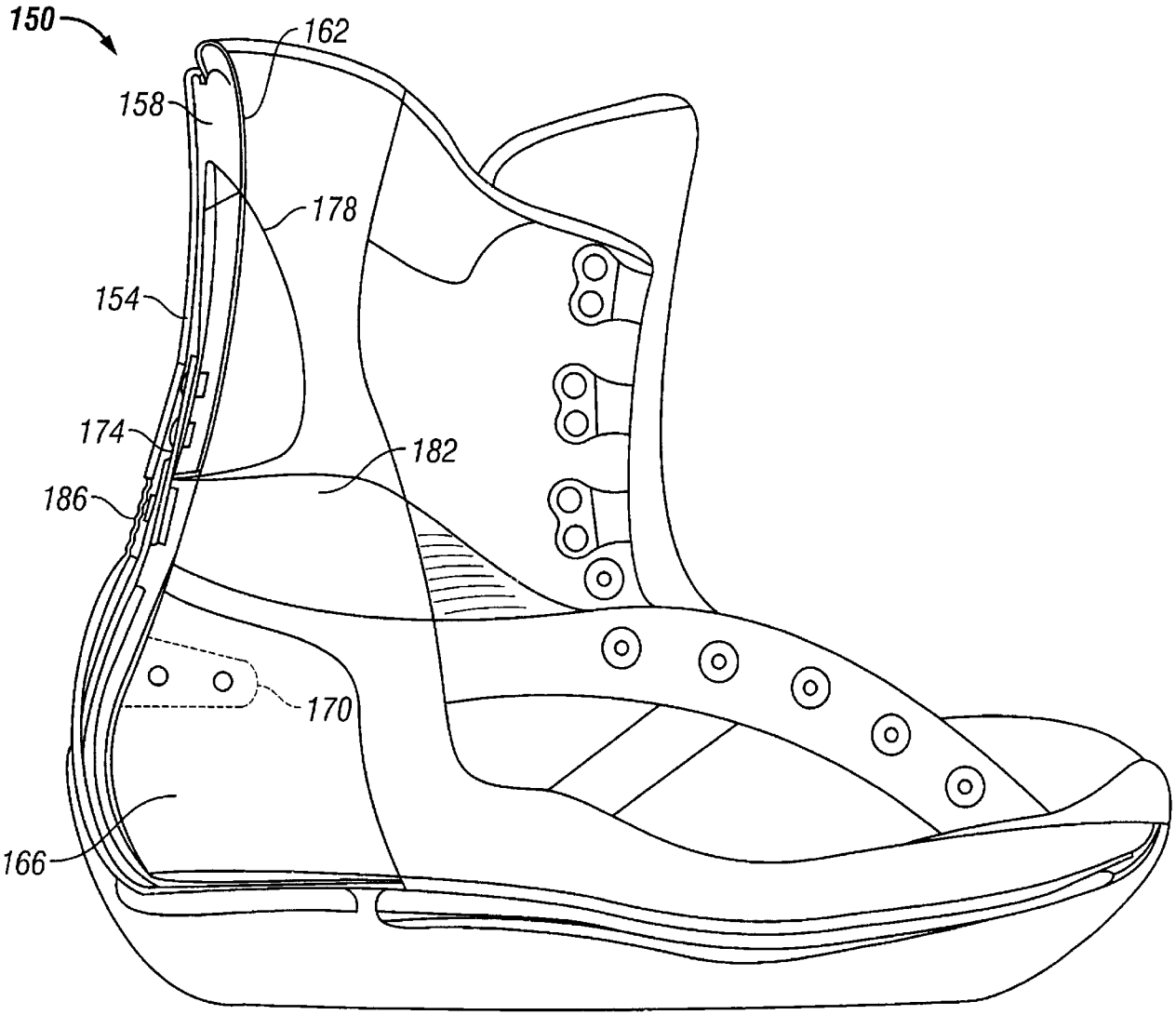
FIG. 13 is a partial cross sectional view of a particular embodiment of a snowboard boot which incorporates a hinged member according to the present invention.

FIG. 13 is a partial cross sectional view of a particular embodiment of a complete snowboard boot 150 according to the present invention. In this embodiment, the snowboard boot includes outer leather layer 154, a middle foam layer 158, and an inner liner layer 162. This type of multi-layer cylindrical structure serves as a rigid reinforcing structure for the snowboard boot. A pivoting structure similar to the structure shown in FIGS. 7–9 is provided in the middle layer of the boot. This pivoting structure comprises a heel cup 166, a metal heel member 170 fixed to heel cup 166, a metal leg member 174 rotatably coupled to metal heel member 170, and a rigid leg member 178 fixed to metal leg member 174. A flexible soft and expandable section 182 is provided between the upper and lower portions of the boot at the approximate location of pivoting of the hinge formed by metal heel member 170 and metal leg member 174. Section 182 may include a flexible rubber layer 186 covering the hinged section. With this snowboard boot, the pivoting structure is completely embedded and protected within the boot.

Figure 14:
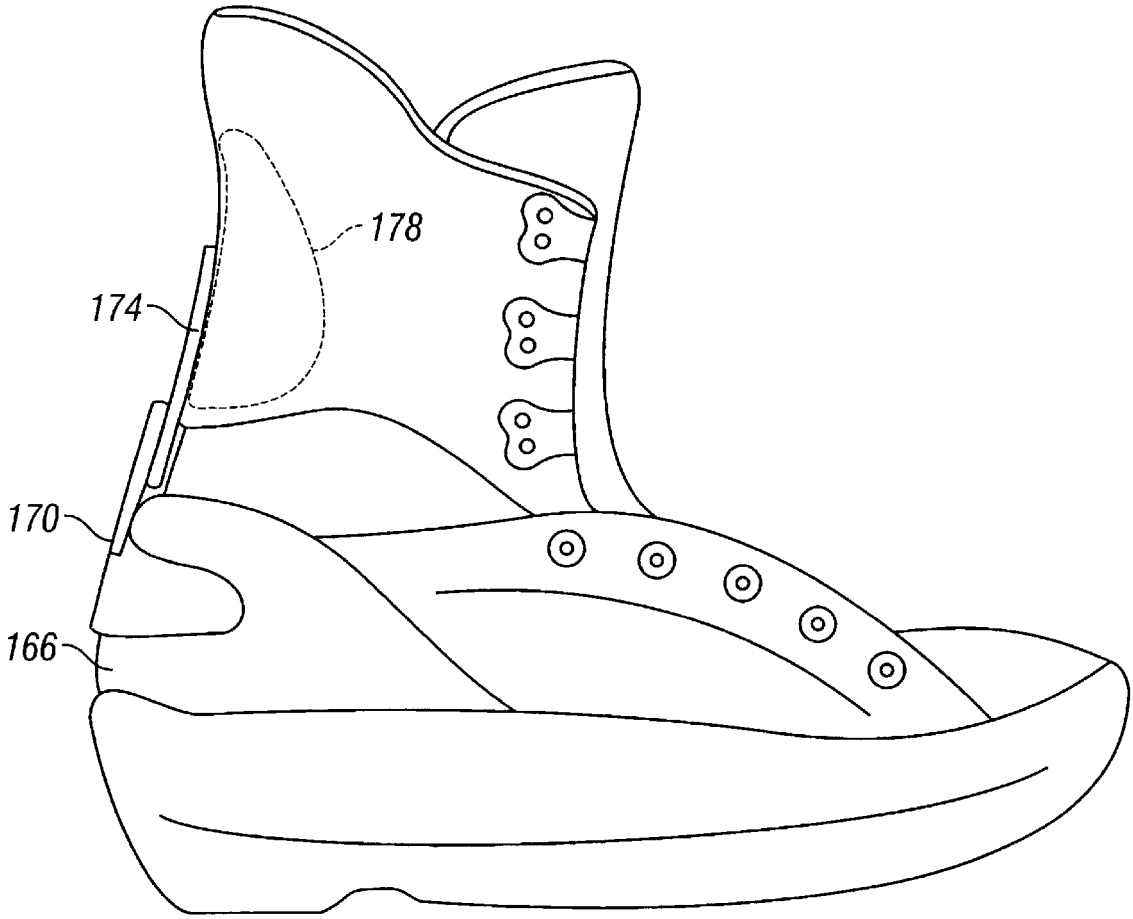
FIG. 14 is a side view of an alternative embodiment of a snowboard boot which incorporates a hinged member according to the present invention.

FIG. 14 is a side view of an alternative embodiment of a snowboard boot which incorporates a hinged member according to the present invention. In this embodiment, the hinged member is disposed on the outside of the boot. In this case, rigid member 178 may be optionally provided inside the boot, or else it could be provided on the outside of the boot.

While the above is a description of various embodiments of the present invention, further modifications may be employed without departing from the spirit and scope of the present invention. For example, the snowboard boot according to the present invention can be used with a step-in type snowboard. In this case cleats are attached to the snowboard boot, and the snowboard may be provided with a disk-type engagement mechanism in which the cleats are engaged by a step-in system. The disk to which the snowboard boot is attached is stationary at the desired rotation position, wherein the axis of rotation rotates in tandem with the snowboard boot so that the angular relationship of the snowboard boot and the snowboard may be changed. The hinge member of the snowboard boot can be designed so as to be moveable. Continuous motion of the hinge member is not required. Insertion holes or the like can be provided in several locations for attaching the hinge member. When moving the position of the hinge member, the angle of incline of the axis of rotation may be changed as well.

Thus, the scope of the invention should not be limited by the specific structures disclosed. Instead, the true scope of the invention should be determined by the following claims. Of course, although labeling symbols are used in the claims in order to facilitate reference to the figures, the present invention is not intended to be limited to the constructions in the appended figures by such labeling.

What is claimed is:

1. A snowboard boot comprising:

a heel member;

a leg member positioned above the heel member;

wherein the heel member is pivotally attached to the leg member at a pivot location so that the leg member is capable of movement relative to the heel member about an axis of rotation that passes through the pivot location;

wherein the axis of rotation is vertically inclined no more than +/−45 degrees;

wherein the axis of rotation lies within a plane that is inclined relative to a longitudinal plane of approximate symmetry which divides left and right sections of the boot;

wherein the pivot location is spaced apart from the longitudinal plane of approximate symmetry;

the heel member including a first upwardly extending heel member protrusion disposed on a first side of the longitudinal plane of approximate symmetry;

a second upwardly extending heel member protrusion disposed on an opposite side of the longitudinal plane of approximate symmetry;

wherein the leg member includes:

a first downwardly extending leg member protrusion disposed on the first side of the longitudinal plane of approximate symmetry; and a second downwardly extending leg member protrusion disposed on the opposite side of the longitudinal plane of approximate symmetry;

wherein the first heel member protrusion overlaps the first leg member protrusion; and wherein the second heel member protrusion overlaps the second leg member protrusion.

2. The boot according to claim 1 further comprising a fastener pivotally coupling the first heel member protrusion to the first leg member protrusion.

3. The boot according to claim 1 wherein the fastener includes a shaft which lies in the axis of rotation.

4. The boot according to claim 1 wherein the second heel member protrusion has an arcuate surface which contacts an arcuate of the second leg member protrusion.

5. The boot according to claim 1 wherein one of the second heel member protrusion or second leg member protrusion includes a slot, and wherein the other one of the second heel member protrusion or second leg member protrusion includes a sliding shaft which slides within the slot when the leg member pivots about the axis of rotation.

6. The boot according to claim 5 wherein the sliding shaft extends along an axis substantially perpendicular to the axis of rotation.

7. A pair of snowboard boots comprising:

a first snowboard boot including:

a first heel member;

a first leg member positioned above the first heel member;

wherein the first heel member is pivotally attached to the first leg member at a first pivot location so that the first leg member is capable of movement relative to the first heel member about a first axis of rotation that passes through the first pivot location;

wherein the first axis of rotation is vertically inclined no more than ±45°;

wherein the first axis of rotation lies within a first plane that is inclined relative to a longitudinal second plane of approximate symmetry which divides left and right sections of the first boot;

wherein the first pivot location is spaced apart from the second plane of approximate symmetry;

a second snowboard boot including:

a second heel member;

a second leg member positioned above the second heel member;

wherein the second heel member is pivotally attached to the second leg member at a second pivot location so that the second leg member is capable of movement relative to the second heel member about a second axis of rotation that passes through the second pivot location;

wherein the second axis of rotation is vertically inclined no more than ±45°, wherein the second axis of rotation lies within a third plane that is inclined relative to a longitudinal fourth plane of approximate symmetry which divides left and right sections of the second boot;

wherein the second pivot location is spaced apart from the fourth plane of approximate symmetry; and wherein an angle of inclination between the first plane and the second plane of approximate symmetry is greater than an angle of inclination between the third plane and the fourth plane of approximate symmetry.

8. The boots according to claim 7 wherein the angle of inclination between the first plane and the second plane of approximate symmetry is in a range of from approximately 23° to approximately 33°.

9. The boots according to claim 8 wherein the angle of inclination between the third plane and the fourth plane of approximate symmetry is in a range from approximately 0° to approximately 8°.

* * * * *